US006951107B1

(12) United States Patent
Bishop

(10) Patent No.: US 6,951,107 B1
(45) Date of Patent: Oct. 4, 2005

(54) TWO STROKE STEAM-TO-VACUUM ENGINE

(76) Inventor: Lloyd E. Bishop, 6807 Wilton Dr., Oakland, CA (US) 94611

( * ) Notice: Subject to any disclaimer, the term of this patent is extended or adjusted under 35 U.S.C. 154(b) by 0 days.

(21) Appl. No.: 10/997,562

(22) Filed: Nov. 26, 2004

(51) Int. Cl.[7] ..... F01K 1/00
(52) U.S. Cl. ..... 60/670
(58) Field of Search ..... 60/670, 659

(56) References Cited

U.S. PATENT DOCUMENTS

| | | | | | |
|---|---|---|---|---|---|
| 740,117 | A | | 9/1903 | Fraley | |
| 768,691 | A | | 8/1904 | Pratt | |
| 2,363,708 | A | * | 11/1944 | Urquhart | 123/3 |
| 2,456,124 | A | * | 12/1948 | Hoffman | 62/63 |
| 3,918,263 | A | * | 11/1975 | Swingle | 60/614 |
| 4,229,943 | A | * | 10/1980 | Kriegler | 60/652 |
| 4,624,109 | A | | 11/1986 | Minovitch | |
| 4,698,973 | A | | 10/1987 | Johnston | |
| 6,128,903 | A | | 10/2000 | Riege | |

* cited by examiner

*Primary Examiner*—Hoang Nguyen
(74) *Attorney, Agent, or Firm*—Brian Beverly

(57) ABSTRACT

A two stroke steam-to-vacuum engine comprises a first cylinder (12) having a first piston (16), a first piston rod (18), and a first steam chamber (24), and a second cylinder (14) having a second piston (30), a second piston rod (32), and a second steam chamber (38). Each piston is reciprocally moveable between an expanded position and a collapsed position. Admission of steam at atmospheric pressure into the steam chambers (24, 38) is controlled by steam valves (52, 54) and exposure of the steam chambers (24, 38) to a vacuum is controlled by vacuum valves (56, 58). The piston rods (18, 32) are fixed for simultaneous reciprocation such that a power stroke in one cylinder produces a steam intake stroke in the other cylinder. Steam to the steam chambers (24, 38) is supplied through a steam reservoir (42) and a solar power source (44), from a boiler, a fuel of choice, or a variety of alternate sources of heat.

25 Claims, 9 Drawing Sheets

TWO STROKE STEAM-TO-VACUUM ENGINE

BACKGROUND OF THE INVENTION

This invention relates to steam engines and particularly to steam engines in which steam at atmospheric to slightly above atmospheric pressure in the steam chamber of a cylinder is exposed to a vacuum causing a power stroke. In particular, this invention is directed to steam-to-vacuum engines having two cylinders having linked pistons, each cylinder of which has a steam chamber which may be exposed to steam at or slightly above atmospheric pressure, which steam exits the cylinder creating a vacuum in that cylinder which permits ambient air pressure to push one of the linked pistons through a power stroke.

The development of modern steam power began with the Savery pump patented by Thomas Savery in 1698, which was used to remove water from mines. It worked by heating water to vaporize it, filling a tank with steam, then creating a vacuum by cutting off the tank from the steam source and then injecting cold water into the tank to condense the steam. The resulting vacuum was used to draw water up from a mine.

Thomas Newcomen (1663–1729) improved on the Savery pump by combining a steam cylinder and piston with a pivoting beam. The beam is heavier on the side opposite the steam cylinder so that gravity pulls that side down. As the heavy side descends, the piston in the steam cylinder rises. Power is created by filling the cylinder with steam at about atmospheric pressure and then spraying water into the cylinder to condense the steam. The resulting vacuum allows atmospheric pressure to push the piston down causing the side of the beam above the cylinder to pivot down and further causing the heavy side of the beam to ascend, filling a pump below the ascending side with water. At the bottom of the power stroke, a valve opens to restore steam to the cylinder, allowing the heavy side of the beam to be pulled back down by gravity to activate the pump. Thus, the Newcomen engine was driven by atmospheric pressure pushing on a piston to fill a vacuum using steam at about atmospheric pressure. Newcomen's engines were inefficient primarily because the steam cylinder was repeatedly heated and cooled, wasting energy to heat the cylinder.

James Watt (1736–1819) made a pioneering breakthrough in 1765 with his discovery that a great efficiency could be achieved by using a separate condenser. Like Newcomen's atmospheric engine, Watt's engine also operates on the principle of atmospheric pressure pushing a piston down. However, valves permit the steam to be sucked into the separated condenser for cooling of the steam and creation of the vacuum. Separating the condenser allows the steam piston and cylinder to remain hot at all times resulting in a substantial increase in efficiency over Newcomen's engine.

Subsequent improvements to steam engine technology focused primarily on high pressure steam and new mechanical designs, leaving production of power using atmospheric pressure vacuum engines relegated to the sidelines.

SUMMARY OF THE INVENTION

A steam-to-vacuum engine according to the invention comprises a first cylinder and a second cylinder. The first cylinder has a first piston defining a first steam chamber in the cylinder. The first piston is reciprocally moveable in the first cylinder delimiting the boundary of the first steam chamber. A first piston rod is attached to the first piston. The second cylinder has a second piston and a second steam chamber. The second piston is likewise reciprocally moveable in the second cylinder delimiting the boundary of the second steam chamber. A second piston rod is attached to the second piston. The cylinders are in fixed spaced relation and the piston rods are linearly connected together by a coupler such that the first and second pistons move simultaneously in fixed reciprocating relation.

A source of steam, e.g., a boiler, a solar collector, or a fuel of choice, produces steam at slightly above atmospheric pressure and is in communication with the first and second cylinders. Preferably, steam is produced at 3–5 p.s.i. above ambient for optimal function. Entry of steam into each cylinder is controlled by a plurality of steam valves. Similarly, exposure of each cylinder to a vacuum is controlled by a plurality of vacuum valves.

The piston in each cylinder is moveable between an expanded position and a collapsed position. When the piston is in the expanded position, the steam chamber is expanded to its maximum volume. When the piston is in the collapsed position, the steam chamber is collapsed to it smallest volume. At the beginning of movement in either cylinder of the piston from the collapsed position to the expanded position, a vacuum valve seals off the steam chamber from the vacuum and a steam valve exposes the steam chamber to the steam source. The steam chamber therefore fills with steam at near atmospheric pressure behind the sliding piston during the expansion defining a steam intake stroke. As the first cylinder moves through the steam intake stroke, the piston in the second cylinder moves from the expanded position to the collapsed position defining a power stroke. At the beginning of the power stroke a steam valve seals off the second cylinder's steam chamber from the steam source and a vacuum valve exposes the steam chamber to the vacuum. Immediately upon exposure of the steam in the steam chamber to the vacuum, the steam rushes out of the steam chamber to the vacuum, leaving a vacuum in the steam chamber in order that atmospheric pressure can drive the piston through the power stroke. Therefore, by coupling the pistons for simultaneous movement, moving one cylinder through the power stroke drives the other cylinder through the steam intake stroke. Accordingly, as the linked pistons reciprocate, one piston in one cylinder is always producing a power stroke, while an intake of steam occurs in the other cylinder, resulting in a two stroke atmospheric steam engine.

In one embodiment of the invention, each cylinder has an air chamber defined by the cylinder walls, a distal wall of the cylinder and the piston. The distal wall is provided with an air valve for controlling entry of air into the air chamber, and with one or a plurality of check valves for controlling the discharge of air from the air chamber, for refined control of the reciprocating movement of the pistons. For example, delaying the inflow of air into a cylinder in which the piston is entering into a power stroke will slow movement of the piston through the power stroke. Alternately, air outflow from the cylinder experiencing the steam intake stroke may be blocked or restricted to slow the progress of the power stroke in the other cylinder.

A steam-to-vacuum engine as described has the significant advantages of producing continuous dual power strokes by linking the pistons, and being able to produce substantial amounts of energy only using steam at near atmospheric pressure. The invention uses steam at relatively low pressure such that steam at required pressures is easily obtained from a wide variety of heat sources including a standard array of solar heating devices, other naturally occurring heat sources, and fuels of choice. After installation, using a non-polluting fuel, power produced by the invention is essentially free and environmentally clean.

BRIEF DESCRIPTION OF THE ILLUSTRATED EMBODIMENTS

DETAILED DESCRIPTION OF THE ILLUSTRATED EMBODIMENTS

Figure 1:
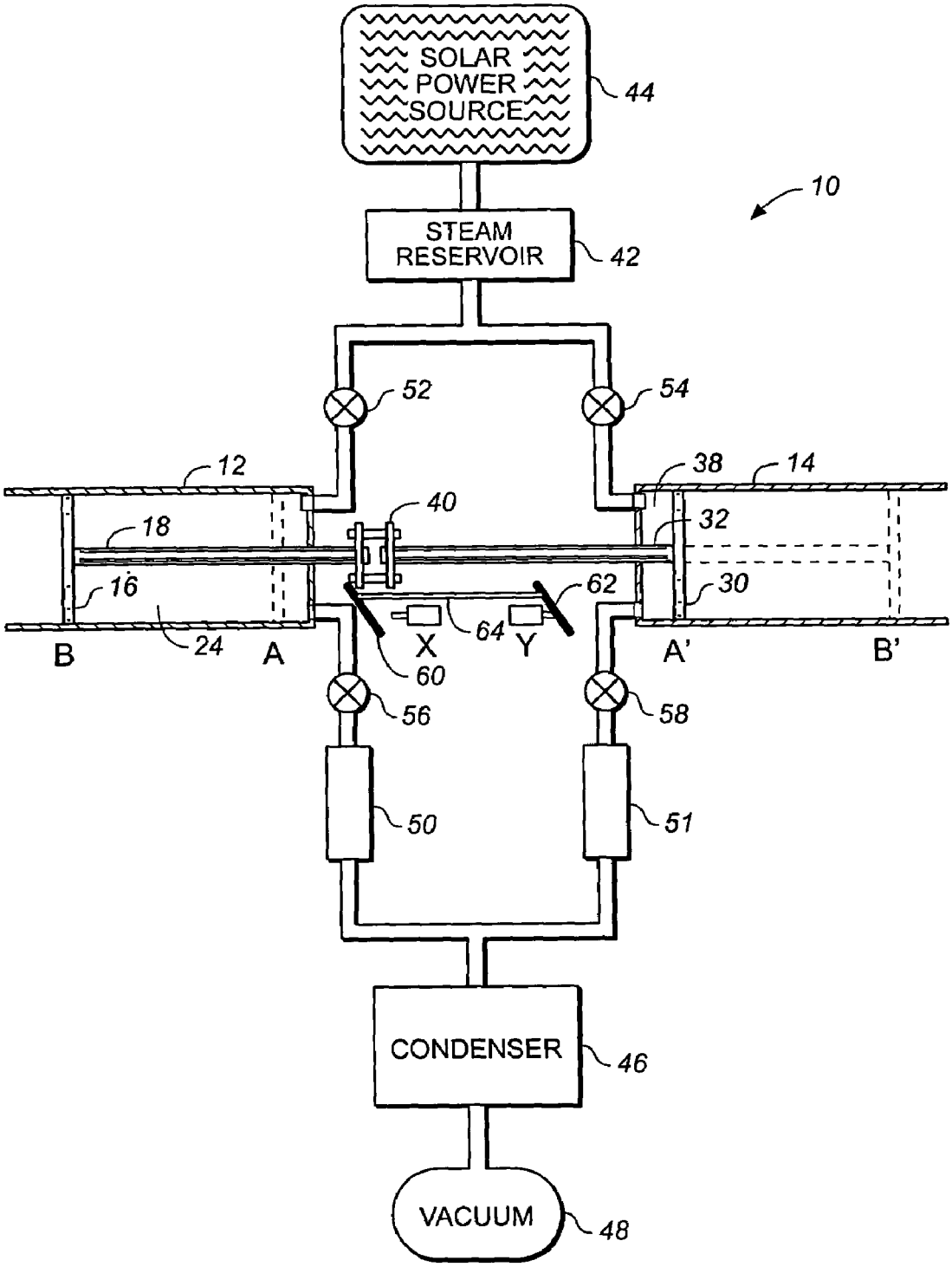
FIG. 1 is a schematic representation of a steam-to-vacuum engine according to the invention.

With reference initially to FIG. 1 of the illustrations, a steam-to-vacuum engine, indicated generally at 10, comprises a first cylinder 12 on the left and a second cylinder 14 on the right. The first cylinder 12 has a first piston 16 and a first piston rod 18. The first piston 16 is moveable between an expanded position B and a collapsed position A defining the moveable boundary of a first steam chamber 24 in the first cylinder 12. The second cylinder 14 similarly has a second piston 30 and a second piston rod 32. The second piston 30 is moveable between an expanded position B' and a collapsed position A' defining the moveable boundary of a second steam chamber 38 in the second cylinder 14.

In the illustrated embodiment, a coupler 40 connects the first and second piston rods 18, 32 such that the first and second pistons 16, 30 are linked in linear relation for simultaneously movement. It will be readily appreciated that there are numerous options available in the art for joining the pistons rods including, for example, forming the pistons rods as one part, forming the piston rods and pistons as one part, and welding the piston rods together.

A steam reservoir 42 is connected to the first and second steam chambers 24, 38 through a plurality of steam valves considered in greater detail below. Water for producing steam is heated by the solar power source 44 shown in FIG. 1, such as an array of solar collectors. Steam at atmospheric pressure will successfully operate the engine, but experimentation has shown that steam at 3–5 psi over ambient will provide for optimum operation. A condenser 46 and vacuum tank 48 are similarly connected to the first and second steam chambers 24, 38 through a plurality of vacuum valves also considered in greater detail below. In the illustrated embodiment steam expansion chambers 50, 51 are provided intermediate the condenser 46 and each cylinder 12, 14 to provide an enlarged vacuum space adjacent to the steam chambers 24, 38 for facilitating the immediate expansion of steam from the steam chambers 24, 38 en route to the vacuum tank 48. A controlled vacuum of 15–20" Hg in the vacuum tank will ensure an instantaneous rush of steam from the cylinder to vacuum producing a vacuum in the cylinder so that air pressure on the piston will make a vigorous power stroke.

In addition to solar collectors, steam at required pressures may also be obtained from geothermal sources and utilizing heat generated by nuclear waste, methane, or natural gas. Nuclear waste is typically stored in canisters having an ambient temperature of 300° F. By using heat exchangers, indefinite amounts of steam can be generated with good radiation control.

Considering first cylinder 12, when the first piston 16 is in the expanded position B, the steam chamber 24 is expanded to its maximum volume. Conversely when the first piston 16 is in the collapsed position A, the steam chamber 24 has its smallest volume. Similarly, when the second piston 30 of the second cylinder 14 is in the expanded position B', the second steam chamber has its maximum volume. When the second piston is in the collapsed position A', the second steam chamber 38 has its smallest volume. Entry of steam into the first steam chamber 24 is controlled by first steam valve 52 which, when open, admits steam from the steam reservoir 42. Entry of steam into the second steam chamber 38 is controlled by a second steam valve 54 when admits steam from the steam reservoir 42 when the valve is opened. When a first vacuum valve 56 is opened, the first steam chamber 24 is exposed to the steam expansion chamber 50, condenser 46, and finally, the vacuum tank 48. When a second vacuum valve 58 is opened, the second steam chamber 38 is exposed to the other steam expansion chamber 51, the condenser 46, and the vacuum tank 48.

With continuing reference to FIG. 1, a first switch X is electrically connected to the steam valves 52, 54 and to the vacuum valves 56, 58. When activated, the first switch closes the first vacuum valve 56 and the second steam valve 54, and opens the first steam valve 52 and the second vacuum valve 58. Hence, when the first switch X is activated, the first steam chamber 24 is placed in open communication with the steam reservoir 42 for admission of steam, and the second steam chamber 38 is put in communication with vacuum tank 48. Accordingly, any steam in the second steam chamber 38 will rush out to the steam expansion chamber 51 and on to the condenser 46 and vacuum tank 48, creating a vacuum in the second steam chamber 38. Ambient air therefore will drive the second piston 30 towards the collapsed position A' which simultaneously moves the first piston 16 towards the expanded position B. It will be readily appreciated that the second piston 30 will not be able to complete the power stroke unless the first piston 16 is free to move from the collapsed position A to the expanded position B. Accordingly, closing the second steam valve 54 prevents steam from interfering with the vacuum in the second steam chamber 38, and closing the first vacuum valve 56 prevents steam in the first steam chamber 24 from going to vacuum.

A second switch Y is also electrically connected to the steam valves 52, 54 and to the vacuum valves 56, 58. When activated, the second switch Y closes the first steam valve 52 and the second vacuum valve 58, and opens the second steam valve 54 and the first vacuum valve 56. Hence, when the second switch Y is activated, the second steam chamber 38 is in open communication with the steam reservoir 42 for admission of steam, and the first steam chamber 24 is in communication with vacuum tank 48. In this state, any steam in the first steam chamber 24 will rush out through the steam expansion chamber 50 and on to the condenser 46 and vacuum tank 48, creating a vacuum in the first steam chamber 24, air pressure then driving the first piston 16 towards the collapsed position A and simultaneously moving the second piston 30 towards the expanded position B'. Obviously, the first piston 16 will not be able to complete the power stroke unless the second piston 30 is free to move from the collapsed position A' to the expanded position B'. Closing the first steam valve 52 to prevent steam from interfering with the vacuum in the first steam chamber 24, and closing the second vacuum valve 58 to prevent steam in the second steam chamber 38 from going to vacuum, allows steam at atmospheric pressure to flow into the second steam chamber 38 thereby equalizing the pressure inside the steam chamber 38 with respect to outside air pressure and permitting the first cylinder 12 to perform work.

Figure 2:
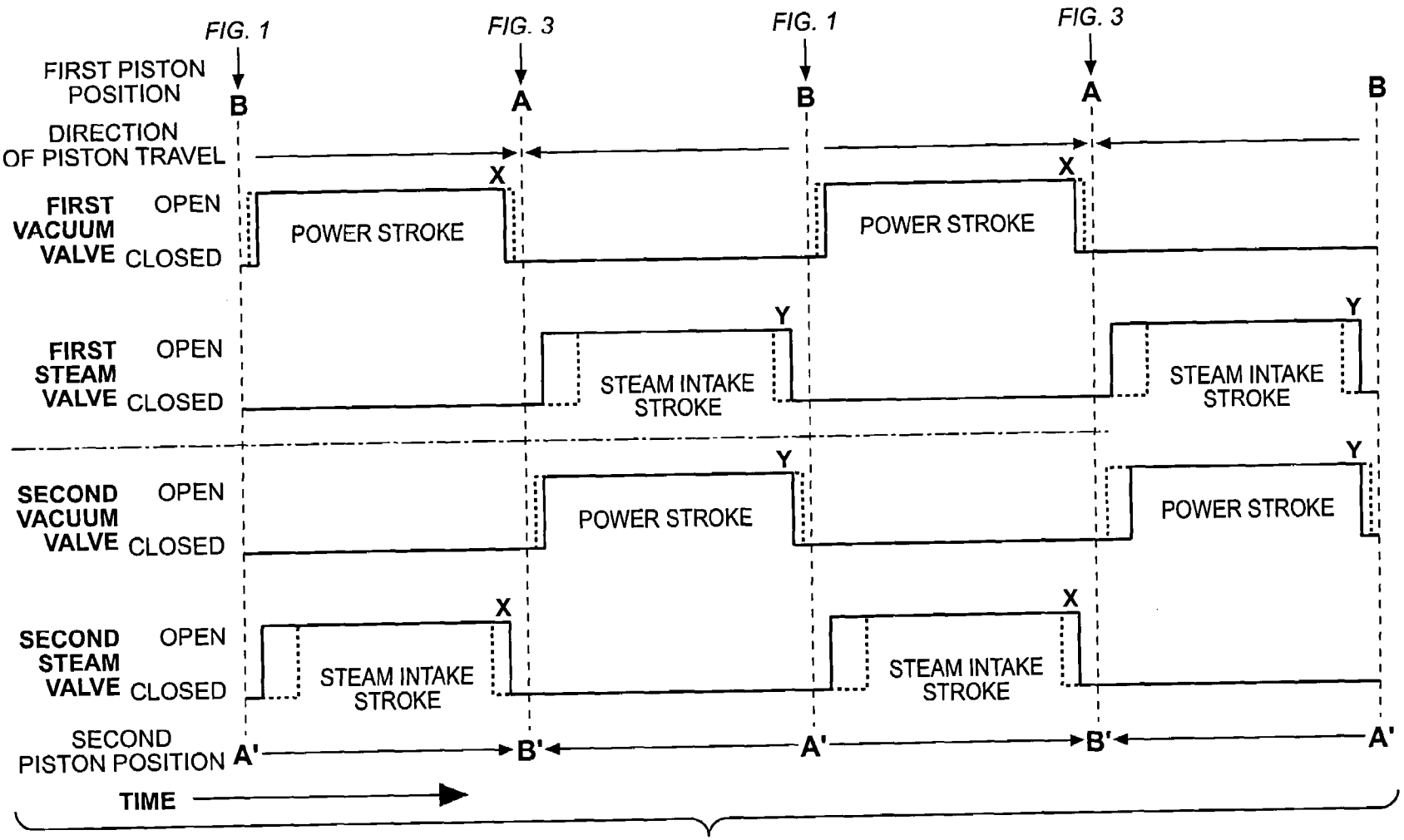
FIG. 2 is a schematic representation of the valve operations of the steam and vacuum valves of the steam-to-vacuum engine depicted in FIG. 1.

With reference now to FIG. 2, the relationship between valves, 52, 54, 56, 58, switches X, Y, and pistons 16, 30 is graphically illustrated. The initial status, indicated at the leftmost broken line B-A', shows the mechanical condition of the valves and pistons immediately before that shown in FIG. 1. Broken line B-A' indicates the exact point at which the first piston 16 is at the expanded position B and at which the second piston 30 is at the collapsed position A'. At that point, the first vacuum valve 56, the first steam valve 52, the second vacuum valve 58, and the second steam valve 54 are all closed. Within a very short increment of time, due to the immediately preceding activation of switch Y, the first vacuum valve 56 and the second steam valve 54 open. It will be appreciated that a delay may be built into the circuit to coordinate when the first vacuum valve 56 and the second steam valve 54 open relative to each other as suggested by the dotted line just to the left of the line indicating that the first vacuum valve 56 is open, and by the dotted line just to the right of the line indicating that the second steam valve 58 is open. As generally shown in FIG. 1, the first vacuum valve 56 will open a very short time before the second steam valve 58 is open. The timing will vary according to the mechanical nuances of different embodiments of the invention. It also will be obvious to one skilled in the art that the first steam chamber 24 must be primed with steam before commencing the first cycle of the engine, absent which there will be no steam to collapse to vacuum in the steam chamber when the first vacuum valve 56 opens. When the first vacuum valve 56 opens, the first piston 16 moves through a power stroke until just before broken line A-B'. During the power stroke the first steam valve 52 and second vacuum valve 58 are both closed.

Moving from left to right in FIG. 2, the second vertical broken line A-B' indicates the point at which the first piston 16 is at the collapsed position A and at which the second piston 30 is at the expanded position B'. Immediately preceding that point, activation of switch X closes the second steam valve 54 and the first vacuum valve 56, terminating conditions for the first cylinder 12 to engage in a power stroke. As indicated by the dotted lines, a delay can be built in to the connections between switch X, on the one hand, and the second steam valve 54 and the first vacuum valve 56, on the other, to determine when the latter close relative to each other. Very quickly after the pistons reach the positions indicated by broken line A-B', switch X opens the first steam valve 52 and the second vacuum valve 58. Accordingly, a vacuum occurs in the second steam chamber 38 permitting ambient air to drive the second piston 30 through a power stroke.

Immediately before the pistons reach the positions indicated by (the second) broken line B-A', switch Y is activated, returning all valves to the closed position for beginning the cycle again. The timing of how close to the piston positions indicated by broken line B-A' (and broken line A-B') that the valves should be opened and closed is a matter of choice to be determined by the size and efficiency of a particular engine embodying the invention. Through a further delay in the circuit, activated switch Y opens the first vacuum valve 56 and the second steam valve 54 to repeat the power stroke in the first cylinder 12.

Figure 1A:
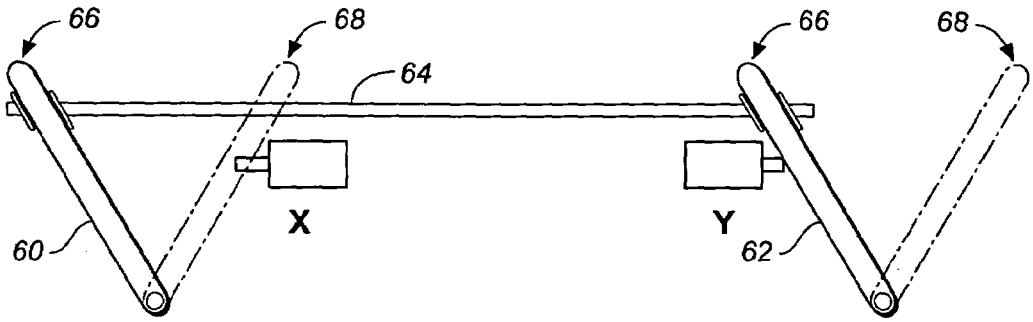
FIG. 1A is an enlarged schematic representation of the controllers and switches of the steam-to-vacuum engine shown in FIG. 1.
Figure 3A:
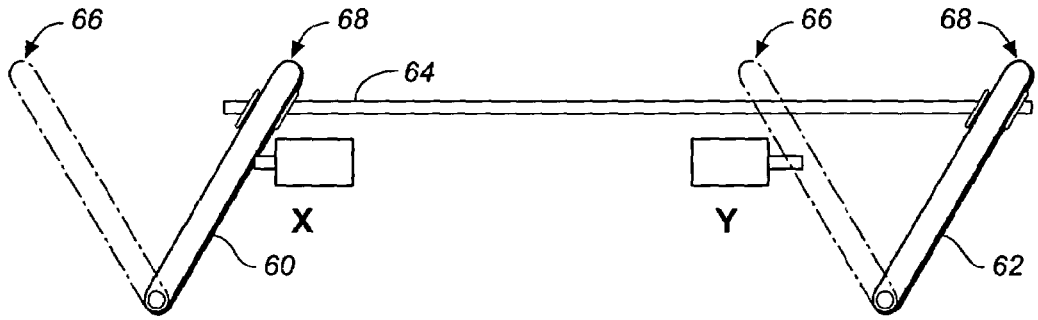
FIG. 3A is an enlarged schematic representation of the controllers and switches of the steam-to-vacuum engine depicted in FIG. 3.

Referring to FIGS. 1 and 1A, a first controller 60 and a second controller 62 are pivotally linked together by horizontal bar 64 for simultaneous pivoting movement between a first position 66 indicated by the solid lines in FIG. 1A and a second position 68 indicated by the dashed lines in FIG. 1A. Intermediate first controller 60 and second controller 62, coupler 40 reciprocates in tandem with pistons 16, 30. As the coupler moves left, it engages the first controller 60, pivoting both controllers 60, 62 to the first position 66 and causing the second controller 62 to activate switch Y. Activation of switch Y, as explained above, drives the first cylinder 12 through a power stroke causing the pistons 16, 30 and, in turn, the coupler 40, to move from left to right. Towards the end of this movement, coupler 40 engages the second controller 62, pivoting both controllers 60, 62 to the second position 68 thereby causing the first controller 60 to engage and activate switch X as shown in FIG. 3A. This, of course, induces a power stroke in the second cylinder 14 which moves the coupler 40 back towards the first controller 60.

Applicant has determined that an operating prototype of a steam-to-vacuum engine according to the invention including cylinders having a 6" diameter and a 13" stroke average 120 strokes per minute. The Newcomen engine at its most rapid operation averaged 15 strokes per minute. It will be easily appreciated that the power output of a Newcomen engine having a 5 foot diameter cylinder and an 8 foot stroke will be exceeded by multiple cylinders of a two stroke steam-to-vacuum engine according to the invention.

Figure 3:
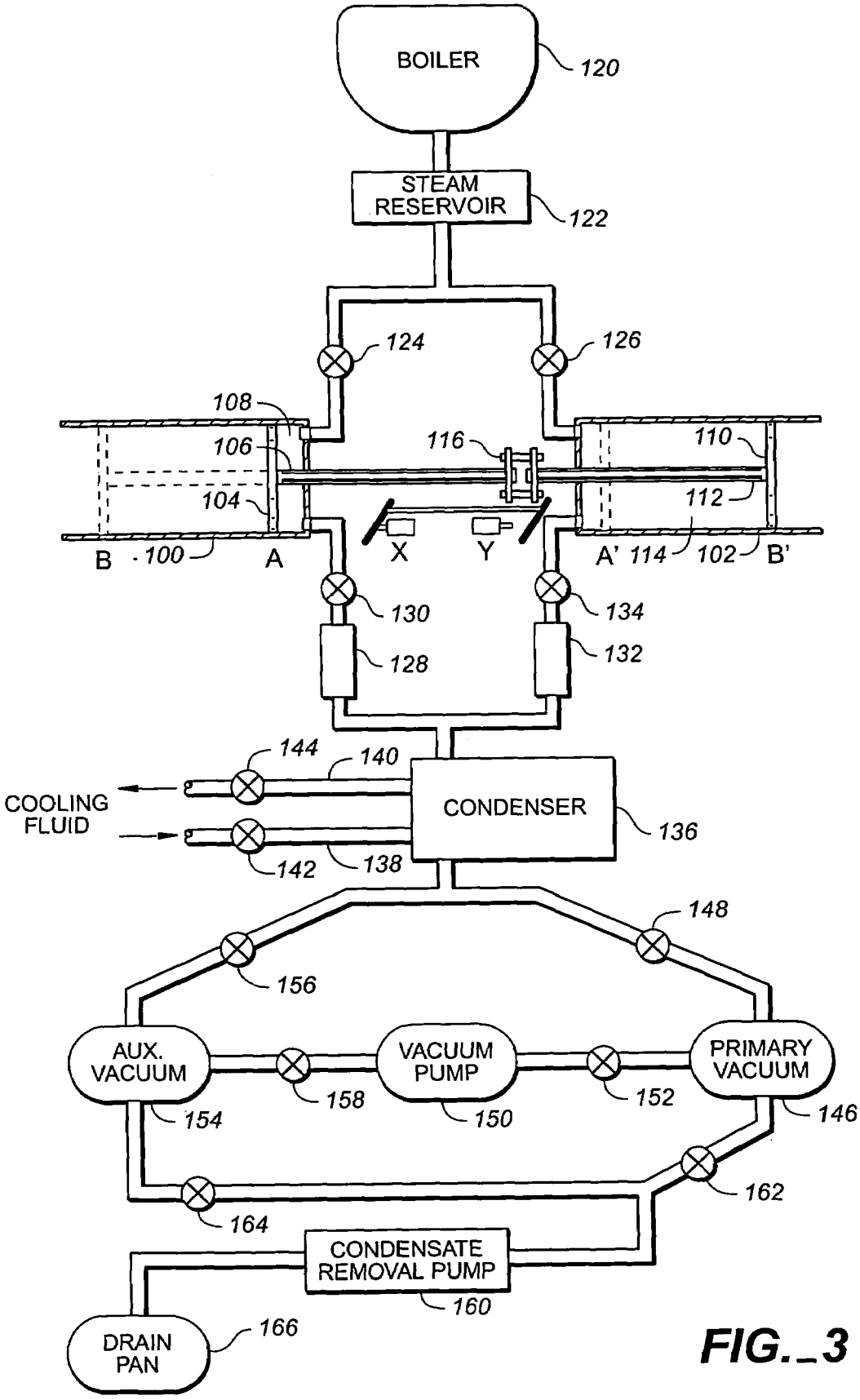
FIG. 3 is a schematic representation of an alternate embodiment of a steam-to-vacuum engine according to the invention.

FIG. 3 shows an alternate embodiment of a steam-to-vacuum engine according to the invention comprising a first cylinder 100 and a second cylinder 102. The first cylinder 100 has a first piston 104 and a first piston rod 106 connected to the first piston 104. The first piston 104 is moveable between a collapsed position A and an expanded position B defining the boundary of a first steam chamber 108. The second cylinder 102 has a second piston 110 and a second piston rod 112 connected to the second piston 110. The second piston is moveable between a collapsed position A' and an expanded position B' defining the boundary of a second steam chamber 114. The first and second piston rods 106, 112 are connected by a coupler 116.

A boiler 120 provides steam for a steam reservoir 122. The steam reservoir 122 is connected to the first steam chamber 108 and the second steam chamber 114, respectively, by a first steam valve 124 and a second steam valve 126. A first expansion chamber 128 is in controlled communication with the first steam chamber 108 via a first vacuum valve 130. A second expansion chamber 132 is in controlled communication with the second steam chamber 114 via a second vacuum valve 134. The expansion chambers 128, 132 are connected to a condenser 136. Cooling fluids flow into the condenser 136 at entry point 138, and flow out at exit point 140. A cooling fluid entry valve controls inflow of the cooling fluid into the condenser 136. Similarly, a cooling fluid exit valve controls the outflow of cooling fluid from the condenser.

A cooling fluid entry valve 142 controls entry of the cooling fluid into the condenser 136. Similarly, a cooling fluid exit valve 144 controls the outflow of cooling fluid from the condenser 136.

The condenser 136 is connected to a primary vacuum 146, exposure to which is controlled by a third vacuum valve 148. The primary vacuum 146 is in communication with a vacuum pump 150 controlled by a first vacuum pump valve 152. The condenser 136 is also connected to an auxiliary vacuum 154, exposure to which is controlled by a fourth vacuum valve 156. The auxiliary vacuum 154 is also connected to the vacuum pump 150, and communication between the auxiliary vacuum 154 and the vacuum pump 150 is controlled by second vacuum pump valve 158.

The primary vacuum 146 and auxiliary vacuum 154 are each connected to a condensate removal pump 160, access to which is controlled by first and second condensate removal valves 162, 164, respectively. The condensate removal pump 160 is connected to a drain pan 166 for collection and, if desired, reuse of condensate.

In operation, steam exiting from one or the other of steam chambers 108, 114 flows first to one or the other of the expansion chambers 128, 132. The expansion chambers provide an expanded void more nearly proximate the steam chambers in order to facilitate the immediate rushing out of steam from the steam chambers 108, 114 by reducing pressure when the first and second vacuum valves 130, 134 are opened.

After passing through the expansion chambers 128, 132, steam flows through the condenser 136. There heat in the steam is transferred to and carried away by the cooling fluid circulating through the condenser, facilitating condensation of the steam to liquid condensate.

After passing through the condenser 136, the condensate will continue flowing through to the primary vacuum 146. Necessarily, the vacuum will require periodic replenishment which is accomplished by activating the vacuum pump 150. Condensate in the primary vacuum 146 drains by gravity out of the primary vacuum 146, is periodically pumped out of the system by the condensate removal pump 160, and is ultimately drawn off to the drain pan 166. The auxiliary vacuum 154 can be used to increase the volume of the operative vacuum that is available or be held ready for use in case of failure of the primary vacuum. Alternatively, it can be used to augment the primary vacuum. As with the primary vacuum 146, any condensate which accumulates in the auxiliary vacuum 154 drains by gravity out of the auxiliary vacuum 154, is pumped out of the system by the condensate removal pump 160, and is drawn off to the drain pan 166.

Figure 4:
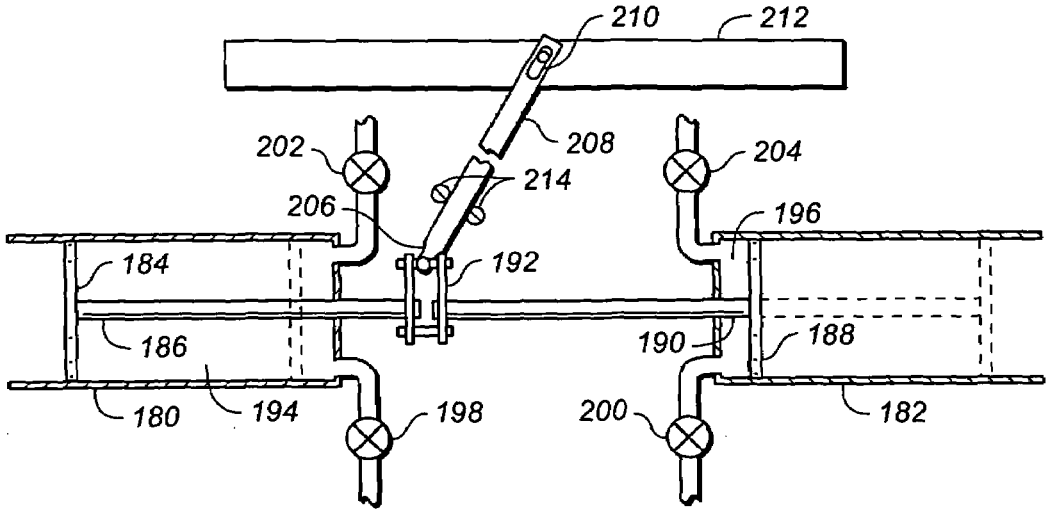
FIG. 4 is a schematic representation of the cylinders of a steam-to-vacuum engine according to the invention showing the coupler attached to a pivot bar.

FIG. 4 shows an alternate embodiment of a steam-to-vacuum engine comprising a first cylinder 180 and a second cylinder 182. The first cylinder 180 has a first piston 184 and a first piston rod 186. The second cylinder 182 has a second piston 188 and a second piston rod 190 connected by a coupler 192. The pistons 184, 188 define first and second steam chambers 194, 196 in the first and second cylinders 180, 182, respectively. Steam is admitted to the first steam chamber 194 through a first steam valve 198, and to the second steam chamber 196 by a second steam value 200. The first steam chamber 194 is in communication with a vacuum controlled by first vacuum valve 202. The second steam chamber 196 is in communication with a vacuum through a second vacuum valve 204.

The coupler 192 is pivotally coupled to the lower end 206 of a pivot bar 208. The top of the pivot bar is pivotally attached about a dog and slat system 210 to a stationary beam 212. The pivot bar 208 is disposed intermediate opposing pickup knobs 214 which are, in turn, attached to a mechanism (not illustrated) for performing work. As the linked piston rods 186, 190 reciprocate the lower end 206 of the pivot bar 208 will likewise reciprocate pivoting the pivot bar relation to the beam. Accordingly, the pickup knobs 214 will be driven through a reciprocating action. Since the pickup knobs are interposed between the coupler 192 and beam 212, the force produced by the engine will be applied to the pivot points on a leveraged ratio.

Figure 5:
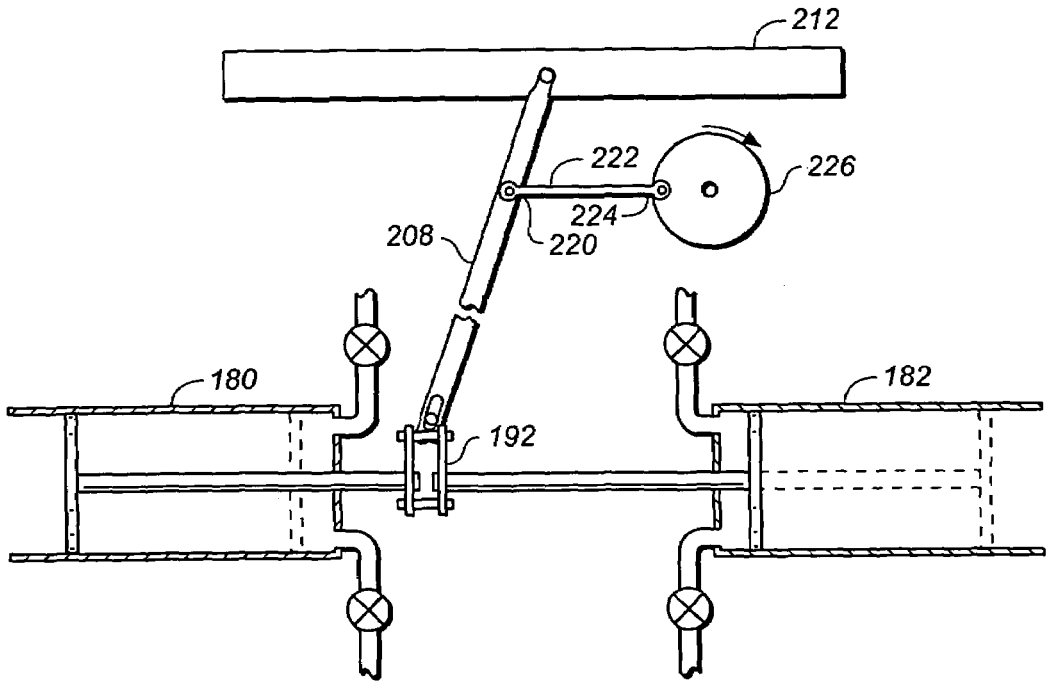
FIG. 5 is a schematic representation of the cylinders of a steam-to-vacuum engine according to the invention showing the coupler attached to a wheel.

FIG. 5 illustrates a fourth embodiment of the invention except that a base end 220 of a horizontal bar 222 is pivotally attached to the pivot bar 208. A distal end 224 of the horizontal bar is pivotally attached to the periphery of a wheel 226. As the coupler 192 engages in reciprocating motion, the base end 220 of the horizontal bar 224 reciprocates, forcing the distal end 224 of horizontal bar 224 to trace a circular path in the direction of the arrow.

Figure 6:
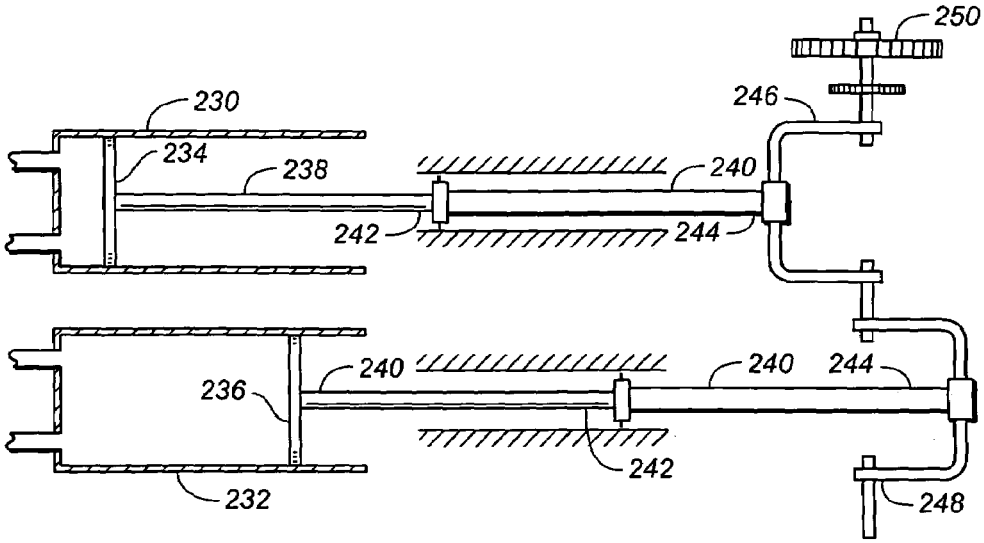
FIG. 6 is a schematic representation of two cylinders of an alternate embodiment of a steam-to-vacuum engine according to the invention linked to a crank assembly.

FIG. 6 illustrates a fifth embodiment of the invention comprising two like oriented, parallel, spaced cylinders 230, 232 having first and second pistons 234, 236 and first and second piston rods 238, 240. In this embodiment, a connecting rod 240 is pivotally attached to the distal end 242 of each piston rod. The distal ends 244 of the extension members are rotatably attached to crank handles 246, 248. The two braces are in fixed and oppositely faced relation and are mutually rotatable in an axis perpendicular to the plane of motion of the piston rods. It win be readily understood that the power stroke of one piston will drive the other piston through a steam intake stroke as described above. The rotation of the fixed braces is therefore translated to an associated wheel 250 for performing work.

Figure 7:
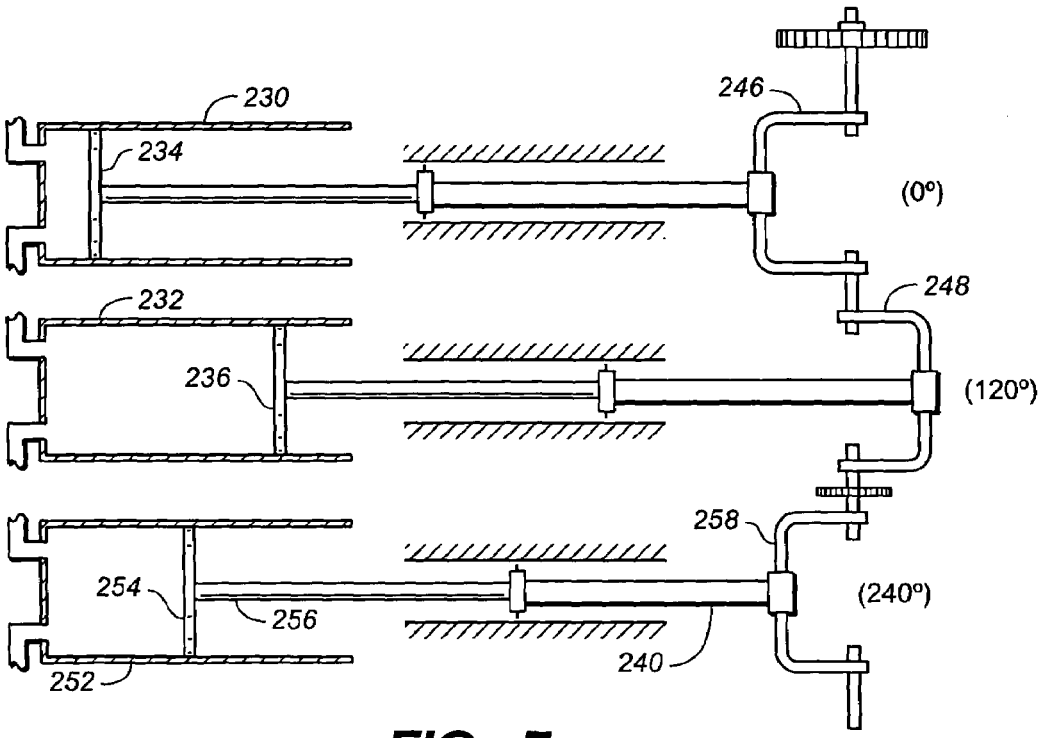
FIG. 7 is a schematic view of three cylinders of an alternate embodiment of a steam-to-vacuum engine according to the invention linked to a crank assembly.

FIG. 7 shows a sixth embodiment of the invention very similar to that shown in FIG. 6 except that a third cylinder 252, piston 254, and piston rod 256 have been added. A third crank handle 258 is attached to the third piston 254 via the piston rod 256 and connecting rod 240. In this embodiment, the first piston 234 is in the collapsed position causing the first crank handle 246 to be in an innermost position (0°) along its rotation. The second piston has moved most of the way through a steam intake cycle towards the expanded position causing the second crank handle 248 to be positioned-approximately 120° through a complete rotation and most of the way towards its outermost position (180°). The third piston 254 is beginning its movement through a power stroke and is still positioned near to, but is moving away from, the expanded position such that the third crank handle 258 has rotated an addition 120° relative to the second crank handle 248, or 240° relative to the first crank handle 246. This relative orientation of the three pistons and handles has the advantage that one cylinder of the three will always be moving through a power stroke, resulting in increased and more smoothly delivered power.

Figure 8:
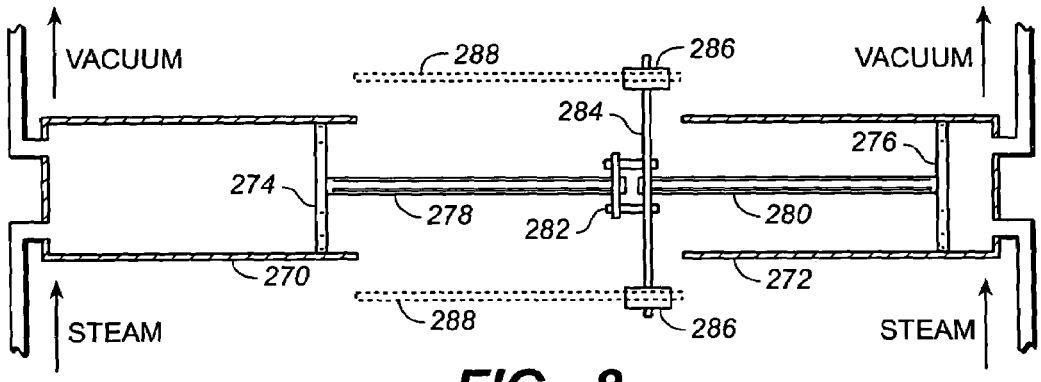
FIG. 8 is a schematic view of two cylinders of an alternate embodiment of a steam-to-vacuum engine according to the invention linked to a slide assembly.

FIG. 8 shows a seventh embodiment of the invention comprising two opposing cylinders 270, 272 having pistons 274, 276 and piston rods 278, 280 joined by a coupler 282. The coupler in this embodiment is attached to a lateral axle on each end of which are provided dual side blocks 286 for guided sliding reciprocating movement along slide bars 288.

Figure 9:
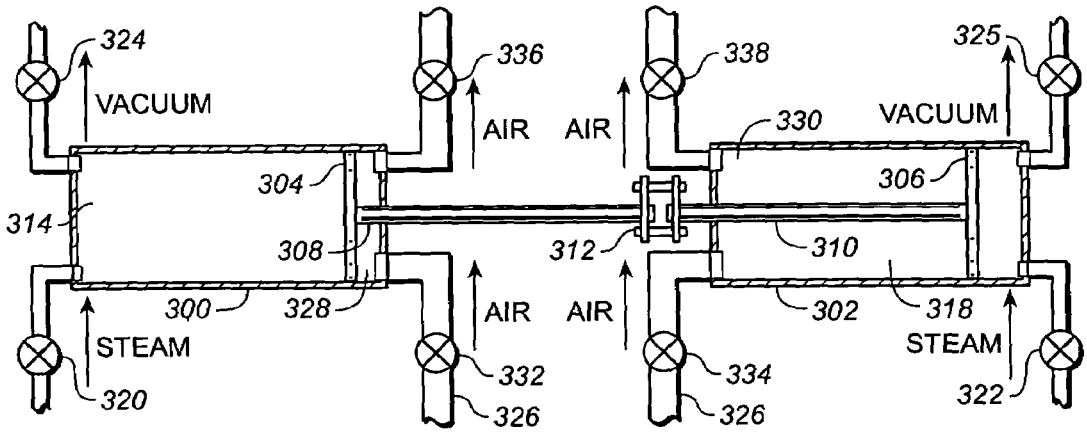
FIG. 9 is a schematic representation of two cylinders of an alternate embodiment of a steam-to-vacuum engine according to the invention showing the steam and vacuum valves relocated to the outer ends of the cylinders and showing air valves installed on the inner ends of each cylinder.

FIG. 9 illustrates an eighth embodiment of the invention comprising a first and second cylinder 300, 302, first and second pistons 304, 306, first and second piston rods 308, 310 joined by a coupler 312, the pistons defining the boundaries of first and second steam chambers 314, 318. In this embodiment, the steam and vacuum valves are connected to the steam chambers on the outer, rather than inner, ends of the respective cylinders. Thus, entry of steam into the first steam chamber 314 is controlled by a first steam valve 320 and entry of steam into the second steam chamber 318 is controlled by a second steam valve 322. Communication of the first steam chamber 314 with the vacuum is controlled by a first vacuum valve 324 and exposure of the second steam chamber 318 to the vacuum is controlled by a second vacuum valve 325.

As discussed above, air must be admitted into the air chambers 314, 318 to push pistons 304, 306 through a power stroke. Conversely, air must be freely released from the air chamber of a cylinder during a steam intake stroke to allow air to push the piston of the other cylinder through a power stroke. Generally, the full power stroke will be delayed until the air valves are opened. Air inflow tubing 326 on the inner ends of the first and second cylinders provides air to first and second air chambers 328, 330 on the rear sides of the pistons 304, 306. Inflow of air into the first air chamber 328 is controlled by a first air valve 332. Similarly, air inflow into the second air chamber 318 is controlled by a second air valve 334. A first check valve 336 is provided on the inner side of the first cylinder 300 in communication with the first air chamber 328. The first check valve 336 permits air to flow out from the first air chamber 328, but prevents admission of air into the air chamber at any pressure. Similarly, a second check valve 338 is provided on the inside end of the second cylinder 302 permitting outflow of air from the second air chamber 318, but prevent inflow of air into the air chamber. Air valves 332, 334 and check valves 336, 338 can be used to control the rate of movement of the pistons 304, 306. For example, restricting the flow of air into air chamber 328 as piston 304 is ready to move through a power stroke will slow or delay the power stroke. Alternately, blocking outflow of air from air chamber 330 by failing to open check valve 338 would create increased pressure in air chamber 330 that would delay the progress of piston 304 through a power stroke. Those of skill in the art will recognize that there are myriad ways to use air valves 332, 334 and check valves 336, 338 to control the rate of the reciprocating movement of pistons 304, 306. Relays may easily be associated with each valve to delay or advance the opening of that valve. Electronic control of any of the valves allows the invention to be controlled by a computer. It will be readily appreciated that a plurality of air valves and check valves can be attached to each cylinder according to the needs of particular situations or for enhanced control.

Figure 10:
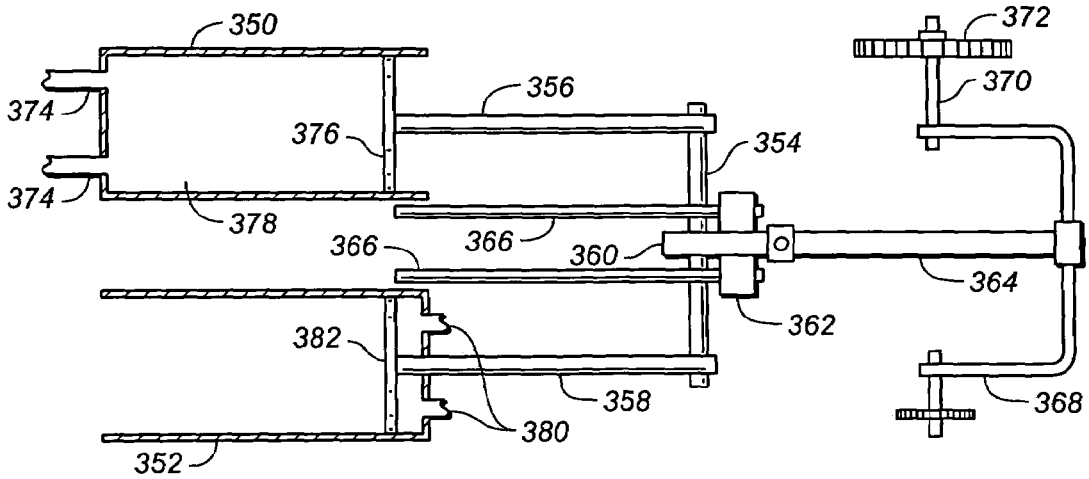
FIG. 10 is a schematic representation of two cylinders of an alternate embodiment of a steam-to-vacuum engine according to the invention linked to a crank assembly.

FIG. 10 shows a ninth embodiment of the invention wherein the first and second cylinders 350, 352 are arranged in parallel alignment. A transverse arbor 354 is attached to the distal ends of the first and second piston rods 356, 358. A gudgeon is 360 attached to the arbor 354 and a slide block 362 fixed to the gudgeon is mounted over two guide bars 366 for guided reciprocating motion. A connecting rod 364 is pivotally attached to the distal end of the gudgeon 360 about an axis perpendicular to the piston rods 356, 358. In regular operation of the device, as the piston rods 356, 358 engage in reciprocal movement, the arbor 354, gudgeon 360 and slide block 362 will move along the guide bars 366 for controlled positioning of the connecting rod 364. A distal end of the extension shaft 364 is pivotally attached to a crank handle 368, rotation of which turns a crank shaft 370 and, in turn, a wheel or gear 372 attached to the crank shaft 370 in order to perform work.

Figure 11:
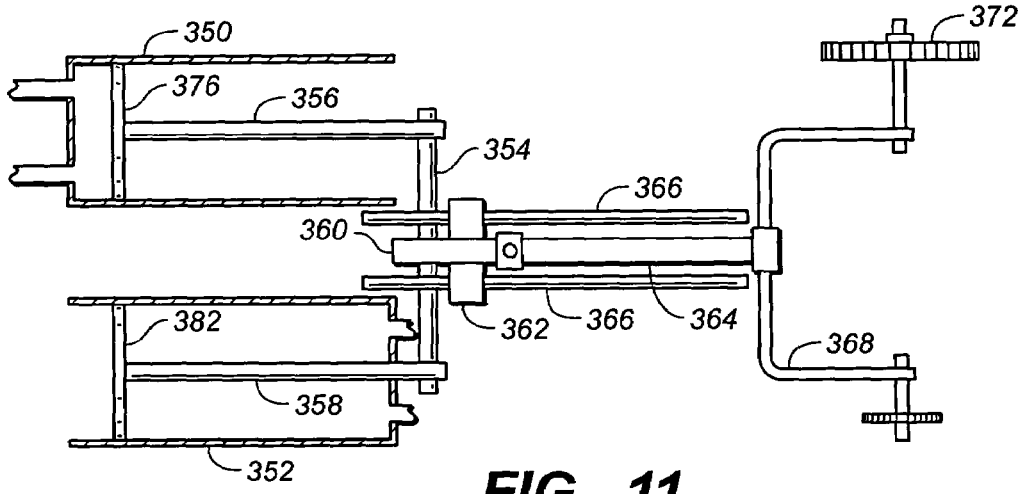
FIG. 11 is a schematic representation of two cylinders of an alternate embodiment of a steam-to-vacuum engine according to the invention linked to a crank assembly.

The first cylinder 350 shown in FIG. 10 is provided with access to steam and exposure to the vacuum via ports 374 on the left side of the cylinder. Accordingly, the position of the first piston 376 as shown in the expanded position is such that the steam chamber 378 is poised for a power stroke. Conversely, access to steam and exposure to the vacuum of the second cylinder 352 is provided via ports 380 on its right side. Accordingly, the second piston 382 is shown in the collapsed position at the end of a power stroke. Therefore, as the pistons 376, 382 move in parallel alignment, the extension shaft 364 engages in reciprocal motion which is translated to rotation of the crank handle 368. In regular operation, when the second cylinder 352 has completed a power stroke moving the pistons 376, 382 to the positions shown in FIG. 10, the extension shaft 364 will have rotated the crank handle 368 to the position shown in FIG. 10. After the first cylinder 350 has moved through a power stroke, driving the pistons 376, 382 to the positions shown in FIG. 11, the extension shaft 364 will have rotated the crank handle 368 to the position shown in FIG. 11.

Figure 12:
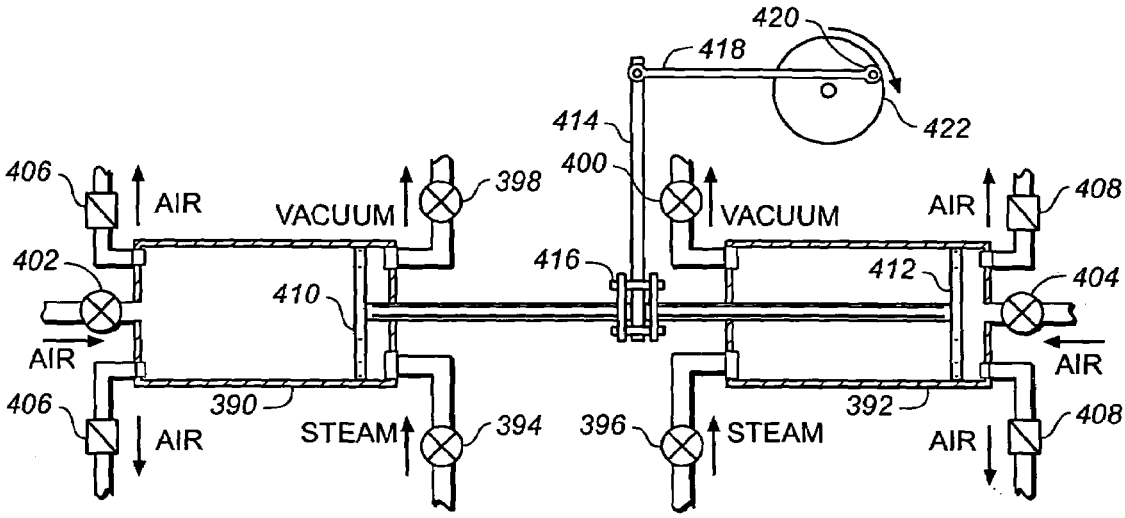
FIG. 12 is a schematic representation of two cylinders of alternate embodiment of a steam-to-vacuum engine showing air valves on the outer ends of the cylinders and showing the invention linked to a wheel.

FIG. 12 shows an eleventh embodiment of the invention wherein the first and second cylinders 390, 392 arranged in parallel relation and the steam valves 394, 396 and vacuum valves 398, 400 are connected to the air chambers on the inner ends of the cylinders. Air valves 402, 404 are provided on the outer ends of the cylinders 390, 392 for controlling admission of air into the air chambers of the cylinders as indicated by the arrows. Check valves 406, 408 are provided on the outer ends of the cylinders 390, 392 for controlling the escape of air from the cylinders. Check valves 406, 408 prevent air from entering the cylinders through the check valves, but allow air to escape from the cylinders as indicated by the immediately adjacent arrows. As discussed above, air valves 402, 404 and check valves 406, 408 can be used to control the rate of the reciprocating movement of pistons 410, 412 in the cylinders 390, 392. A vertical arm 414 extends upwardly from coupler 416, an upper part of the arm 414 pivotally joined to a link arm 418. A distal end 420 of the link arm 418 is pivotally attached to the periphery of a rotating wheel 422 such that reciprocal motion of the pistons 410, 412 is translated to rotational movement of the wheel 422.

Figure 13:
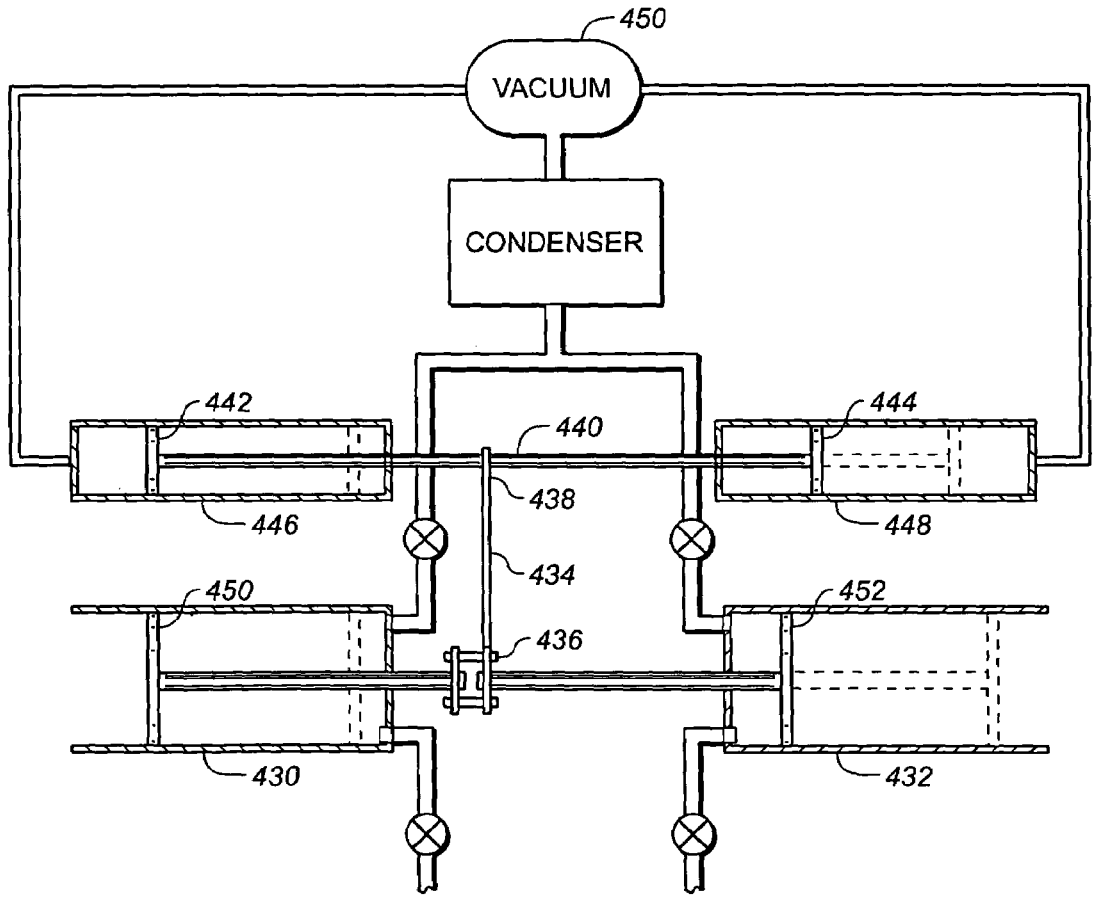
FIG. 13 is a schematic representation of two cylinders of an alternate embodiment of a steam-to-vacuum engine showing vacuum pumps operated by the engine for replenishing the vacuum.

FIG. 13 shows a twelfth embodiment of the invention wherein first and second cylinders 430, 432 are in parallel relation. A vertical arm 434 is attached to and extends upwardly from coupler 436. The upper end 438 of the vertical arm 434 is attached to a horizontal piston rod 440. At each end of the piston rod 440, pistons 442, 444 engage in reciprocal movement within vacuum pumps 446, 448 in tandem with pistons 450, 452 of the first and second cylinders 430, 432. Vacuum pumps 446, 448 are in communication with vacuum 450 such that reciprocal movement of the pistons 450, 452 will drive the piston rod 440 to operate the vacuum pumps 446, 448 to replenish the vacuum 450 automatically during operation of the engine.

There have thus been described certain preferred embodiments of a steam-to-vacuum engine. While preferred embodiments have been described and disclosed, it will be recognized by those with skill in the art that modifications are within the true spirit and scope of the invention. The appended claims are intended to cover all such modifications.

I claim:

1. A steam-to-vacuum engine comprising:

a first cylinder having a first piston and a first steam chamber, said first piston bounding said first steam chamber, a second cylinder having a second piston and a second steam chamber, said second piston bounding said second steam chamber, said first and second pistons connected for synchronous movement, each piston in each of said cylinders moveable between an expanded position and a collapsed position, movement from said expanded position to said collapsed position defining a power stroke, and movement from said collapsed position to said expanded position defining a steam intake stroke, a power stroke in one of said first and second cylinders occurring simultaneously with a steam intake stroke in the other of said first and second cylinders, a plurality of valves controlling exposure of said steam chamber of one of said first and second cylinders to a vacuum during the power stroke of each one of said cylinders, and said plurality of valves further controlling admission of steam into said steam chamber of one of said first and second cylinders during the steam intake stroke of each one of said cylinders, the power stroke in one of said cylinders driving the steam intake stroke in said other cylinder.

2. The steam-to-vacuum engine of claim 1 further comprising:

a first piston rod attached to said first piston, a second piston rod attached to said second piston, and a coupler connecting said first and second pistons.

3. The steam-to-vacuum engine of claim 2 wherein:

said first and second piston rods are disposed in parallel relation.

4. The steam-to-vacuum engine of claim 2 wherein:

said first and second piston rods are fixed in linear relation.

5. The steam-to-vacuum engine of claim 1 further comprising:

a steam source in controlled communication with said first and second steam chambers.

6. The steam-to-vacuum engine of claim 5 wherein:

said steam source comprises a steam reservoir.

7. The steam-to-vacuum engine of claim 5 wherein:

said steam source comprises at least one solar collector.

8. The steam-to-vacuum engine of claim 5 wherein:

said plurality of valves comprises a plurality of steam valves for controlling communication of said steam source with said first and second steam chambers.

9. The steam-to-vacuum engine of claim 1 wherein:

steam admitted into said steam chamber during said steam intake stroke having a pressure approximately equivalent to atmospheric pressure.

10. The steam-to-vacuum engine of claim 5 wherein:

steam from said steam source is provided to said first and second steam chambers at 3 to 5 p.s.i. over ambient atmospheric pressure.

11. The steam-to-vacuum engine of claim 1 further comprising:

a vacuum in controlled communication with said first and second steam chambers.

12. The steam-to-vacuum engine of claim 11 wherein:

said plurality of valves comprises a plurality of vacuum valves for controlling communication of said vacuum with said first and second steam chambers.

13. The steam-to-vacuum engine of claim 1 further comprising:

a steam source in controlled communication with said first and second steam chambers, and a vacuum in controlled communication with said first and second steam chambers, during said steam intake stroke of one of said first and second cylinders, said steam chamber of said one cylinder generally closed to said vacuum and generally open to said steam source, and said steam chamber of the other of said first and second cylinders generally closed to said steam source and generally open to said vacuum, and during said power stroke of one of said first and second cylinders, said steam chamber of said one cylinder generally closed to said steam source and generally open to said vacuum, and said steam chamber of the other of said first and second cylinders generally closed to said vacuum and generally open to said steam source.

14. The steam-to-vacuum engine of claim 1 further comprising:

an extension shaft attached to said first and second pistons for transferring power to a machine.

15. The steam-to-vacuum engine of claim 1 further comprising:

each of said first and second cylinders having a distal wall, said distal wall and said piston in each of said first and second cylinders bounding an air chamber.

16. The steam-to-vacuum engine of claim 15 further comprising:

each of said first and second cylinders having at least one air valve controlling inflow of air into said air chamber.

17. The steam-to-vacuum engine of claim 16 further comprising:

each of said first and second cylinders having at least one check valve for discharging air from said air chamber.

18. The steam-to-vacuum engine of claim 1 wherein:

said plurality of valves comprises a first steam valve for controlling entry of steam from said steam source into said first steam chamber, a second steam valve for controlling entry of steam from said steam source into said second steam chamber, a first vacuum valve for controlling communication of said vacuum with said first steam chamber, and a second vacuum valve for controlling communication of said vacuum with said second steam chamber.

19. The steam-to-vacuum engine of claim 18 further comprising:

a first switch operatively connected to said first steam valve and said second vacuum valve, said first switch having a first state and a second state, in said first state said first switch simultaneously opening said first steam valve and said second vacuum valve, and in said second state said first switch simultaneously closing said first steam valve and said second vacuum valve, a second switch operatively connected to said second steam valve and said first vacuum valve, said second switch having a first state and a second state, in said first state said second switch simultaneously opening said second steam valve and said first vacuum valve, and in said second state said second switch simultaneously closing said second steam valve and said first vacuum valve, a first controller for controlling the state of said first switch, and a second controller for controlling the state of said second switch, said second controller linked to said first controller, said first and second controllers simultaneously moveable between a first position and a second position, in said first position said first switch being in said first state and said second switch being in said second state, and in said second position said first switch being in said second state and said second switch being in said first state, and said coupler in cyclic contact with said controllers for moving said controllers from one to the other of said first and second positions.

20. The steam-to-vacuum engine of claim 19 further comprising:

said first controller comprising a first pivot arm and said second controller comprising a second pivot arm, and a link pivotally joining said first and second pivot arms, said coupler disposed intermediate said first and second pivot arms, said cyclic motion of said coupler comprising a linear reciprocating motion.

21. The steam-to-vacuum engine of claim 1 further comprising:

at least one heat exchanger in controlled communication with said first steam chamber and said second steam chamber, said heat exchanger in communication with said vacuum.

22. The steam-to-vacuum engine of claim 21 further comprising:

at least one expansion chamber in controlled communication with said first steam chamber and said second steam chamber, said expansion chamber in communication with said at least one heat exchanger.

23. The steam-to-vacuum engine of claim 22 wherein:

said at least one expansion chamber comprises at least a first expansion chamber and a second expansion chamber, said first expansion chamber in controlled communication with said first steam chamber, and said second expansion chamber in controlled communication with said second steam chamber.

24. A steam-to-vacuum engine comprising:

a first cylinder having a first piston and a first steam chamber, said first piston bounding said first steam chamber, a first piston rod attached to said first piston, a second cylinder having a second piston and a second steam chamber, said second piston bounding said second steam chamber, a second piston rod attached to said second piston, a coupler connecting said first and second piston rods, a steam source in controlled communication with said first steam chamber and said second steam chamber, a vacuum in controlled communication with said first steam chamber and said second steam chamber, and a plurality of valves for controlling communication of said steam source with said first and second steam chambers and for controlling communication of said vacuum with said first and second steam chambers, each piston in each of said cylinders moveable between an expanded position and a collapsed position, each steam chamber of each said cylinder having an expanded volume when said piston of said cylinder is in said expanded position, movement of said piston from said expanded position to said collapsed position defining a power stroke, each steam chamber of each said cylinder having a collapsed volume when said piston of said cylinder is in said collapsed position, and movement of said piston from said collapsed position to said expanded position defining a steam intake stroke, a power stroke in one of said first and second cylinders occurring simultaneously with a steam intake stroke in the other of said first and second cylinders, during said steam intake stroke of one of said first and second cylinders, said steam chamber of said one cylinder generally closed to said vacuum and generally open to said steam source, and said steam chamber of the other of said first and second cylinders generally closed to said steam source and generally open to said vacuum, and during said power stroke of one of said first and second cylinders, said steam chamber of said one cylinder generally closed to said steam source and generally open to said vacuum, and said steam chamber of the other of said first and second cylinders generally closed to said vacuum and generally open to said steam source, successive iterations of said power stroke and said steam intake stroke engaging said coupler in cyclic motion, said coupler in operative communication with said plurality of valves for opening and closing said valves.

25. A steam-to-vacuum engine comprising:

a first cylinder having a first piston, said first piston bounding a first cylinder chamber, a first piston rod attached to said first piston, a second cylinder having a second piston, said second piston bounding a second cylinder chamber, a second piston rod attached to said second piston, a coupler connecting said first and second piston rods in linear relation for synchronous movement of said pistons, a steam source in communication with said first cylinder and said second cylinder, a first steam valve for controlling entry of steam from said steam source into said first cylinder, a second steam valve for controlling entry of steam from said steam source into said second cylinder, a vacuum in communication with said first cylinder and said second cylinder, a first vacuum valve for controlling communication of said vacuum with said first cylinder, a second vacuum valve for controlling communication of said vacuum with said second cylinder, a first switch operatively connected to said first steam valve and said second vacuum valve for simultaneously opening or closing said first steam valve and said second vacuum valve, said first switch having a first state and a second state, in said first state said first switch simultaneously opening said first steam valve and said second vacuum valve, and in said second state said first switch simultaneously closing said first steam valve and said second vacuum valve, a second switch operatively connected to said second steam valve and said first vacuum valve for simultaneously opening or closing said second steam valve and said first vacuum valve, said second switch having a first state and a second state, in said first state said second switch simultaneously opening said second steam valve and said first vacuum valve, and in said second state said second switch simultaneously closing said second steam valve and said first vacuum valve, a first controller for controlling the state of said first switch, and a second controller for controlling the state of said second switch, said second controller linked to said first controller, said first and second controllers simultaneously moveable between a first position and a second position, in said first position said first switch being in said first state and said second switch being in said second state, and in said second position said first switch being in said second state and said second switch being in said first state, each piston in each of said cylinders moveable between an expanded position and a collapsed position, each steam chamber of each said cylinder having an expanded volume when said piston of said cylinder is in said expanded position, movement of said piston from said expanded position to said collapsed position defining a power stroke, each steam chamber of each said cylinder having a collapsed volume when said piston of said cylinder is in said collapsed position, and movement of said piston from said collapsed position to said expanded position defining a steam intake stroke, a power stroke in one of said first and second cylinders occurring simultaneously with a steam intake stroke in the other of said first and second cylinders, said coupler in cyclic contact with said controllers moving said controllers alternately to said first and second positions.

* * * * *